United States Patent [19]

Gräbener et al.

[11] Patent Number: 4,917,588

[45] Date of Patent: Apr. 17, 1990

[54] PRESS FOR MOLDING ARTICLES FROM POWDERED MATERIALS AND DRIVE MEANS THEREFOR

[75] Inventors: Thomas Gräbener, Siegen; Theodor Gräbener, Netphen, both of Fed. Rep. of Germany

[73] Assignee: Theodor Grabener Pressensysteme GmbH & Co. KG, Netphen, Fed. Rep. of Germany

[21] Appl. No.: 191,289

[22] Filed: May 6, 1988

[30] Foreign Application Priority Data

May 7, 1987 [EP] European Pat. Off. ..... 87106634.6

[51] Int. Cl.[4] ..... B30B 15/14; B30B 15/16

[52] U.S. Cl. ..... 425/150; 264/40.5; 425/162; 425/167; 425/406

[58] Field of Search ..... 264/40.5; 425/150, 162, 425/167, 406

[56] References Cited

U.S. PATENT DOCUMENTS

| | | | |
|---|---|---|---|
| 2,572,953 | 10/1951 | Saari | 425/422 |
| 2,825,092 | 3/1958 | Hatch et al. | 425/78 |
| 3,545,045 | 12/1970 | Vinson | 425/78 |
| 3,868,201 | 2/1975 | Jacobson et al. | 425/162 |
| 4,088,432 | 5/1978 | Farrell | 425/150 |
| 4,270,890 | 6/1981 | Ottl | 425/150 |
| 4,363,612 | 12/1982 | Walchhutter | 425/167 |
| 4,373,889 | 2/1983 | Brown | 425/150 |
| 4,392,800 | 7/1983 | Apuzzo | 425/162 |
| 4,439,129 | 3/1984 | Long et al. | 425/167 |
| 4,447,198 | 5/1984 | Long et al. | 425/150 |
| 4,552,524 | 11/1985 | Schmidts et al. | 425/406 |
| 4,565,517 | 1/1986 | Brinkmann et al. | 425/406 |

FOREIGN PATENT DOCUMENTS

| | | |
|---|---|---|
| 224096 | 6/1987 | European Pat. Off. . |
| 867514 | 2/1953 | Fed. Rep. of Germany . |
| 3142126 | 5/1983 | Fed. Rep. of Germany . |

*Primary Examiner*—Jay H. Woo
*Assistant Examiner*—C. Scott Bushey
*Attorney, Agent, or Firm*—Fitch, Even, Tabin & Flannery

[57] ABSTRACT

A press is described which is particularly suitable for the production of precision moldings from pulverized materials. The press is provided with a frame 3 in which a draft frame 5 and a platen 4 acting together provide the axis, and are connected to one another by means of a mechanical drive, preferably a toggle drive system, for relative movement to form a main press ram. In the main press ram, between the movable draft frame 5 and the platen 4, a hydraulic subpress 12 is arranged together with at least one additional axis, preferably however with several such axes. Control and regulation of the timing and extent of the working movement of each axis in the hydraulic subpress 12 are made to depend, through a control system 22–33, on the working movement of the main axis formed by the draft frame 5 and the platen 4 of the mechanical press 2.

13 Claims, 6 Drawing Sheets

2
5
IV
4
43
41
42
7
9
6
8
5
11
10
34
3

PRESS FOR MOLDING ARTICLES FROM POWDERED MATERIALS AND DRIVE MEANS THEREFOR

BACKGROUND OF THE INVENTION

The present invention concerns a press which is particularly suitable for the production of precision moldings from pulverized materials, but which lends itself to use in other applications, such as the molding of plastics and the deep-drawing, swaging and stamping of metals.

The basis on which the present invention proceeds is a mechanical press having a base frame supporting a movable draft frame and a fixed platen, coupled to one another by a drive toggle for relative movement to constitute the main press ram acting on the so-called principal guide axis. Associated therewith, in accordance with the invention, are one or more hydraulically-operated auxiliary axes whose operation is adjustably timed and regulated in response to movement of the ram on the principal axis.

Automatic hydraulic presses for the production of precision moldings from pulverized materials are already known, which can also be employed for the production of complex moldings, especially moldings of single or multiple stepped configuration (see document DE-OS 31 42 126, for example). For each molding step, the actual pressing tool operates on its own molding axis which is assigned to a special hydraulic drive unit inside the press, so that a different working path relative to the pressing tool is followed and/or must be controlled by each hydraulic drive unit as it moves between its charging and operating positions.

In such types of automatic presses, mainly on account of the shape of the molding to be produced, the movement pattern between the individual hydraulic drives will necessarily be somewhat complex, and such a movement pattern can only be actuated and monitored with the help of complicated electronic control systems.

However, the systems provided in any of the known types of automatic hydraulic presses are not capable of ensuring that the movements of the various hydraulic drives are actually carried out in each molding operation in a precisely coordinated way. In particular, there is no means of ensuring consistent maintenance of the hydraulic fluid supply to the various hydraulic units at continuous, precise quantities and rates because pressure compounding is a frequent occurrence. As a result, undefined compound movements of the hydraulic drives will occur and these cannot be compensated by the electronic control system, and can have an adverse effect upon molding quality.

A further disadvantage of known types of automatic hydraulic presses is the relatively long stroke of all of the hydraulic drives, which allows only relatively limited stroke rates, constituting a further constraint on productivity.

SUMMARY OF THE INVENTION

Consequently, the purpose of the present invention is to provide a press of the type first described above which not only ensures perfectly repeatable operation of all the operating axes which operate together, but which can be operated at relatively high stroke rates at the same time. A further aim of the present invention is to provide a high level of dimensional stability throughout the entire press system accompanied by continuous operating reliability.

At the same time, the various operating axes must be provided with flexible actuating and drive arrangements, and the movement control system must be independent of hydraulic pressure.

These aims are met in accordance with the invention by providing, between the draw frame and platen, a hydraulic subpress with at least one additional operating axis and preferably several additional operating axes, wherein the kinetics and time functions of the working movement of each operating axis of the aforesaid hydraulic subpress can be made adjustably dependent upon the working movement of the draw frame and platen on the principal press axis of the mechanical press.

The advantage of a press system of this type lies in the fact that it can be realized by the simple incorporation of an additional hydraulic subpress into a mechanical press of a type which is already available, in particular a toggle press.

Because it is possible to arrange for the present operating paths of the operating axis or axes of the hydraulic subpress and the path of the operating axis of the mechanical press to be different from one another, a further advantage of the present invention is that it provides the combination of a long stroke and high stroke rate of the mechanical press with the considerably shorter stroke of the hydraulic subpress, thus allowing high stroke rates in a multiple-axis press.

In the hydromechanical press system according to the present invention, the mechanical press not only allows a long stroke and a high stroke rate, but the system also has a particularly advantageous effect on the guidance and control functions affecting all the hydraulically actuated working movements. This provides an optimal degree of repeatability and operating reliability, and at the same time provides for flexible movement by the hydraulic subpress.

As a further feature of the present invention, each operating axis of the hydraulic subpress is coupled, or provision made for such coupling, to the main operating axis through an electric or electronic position sensor. Furthermore, the operating axes of the hydraulic subpress can be freely program-coupled to the position sensor assigned to the mechanical press through electronic position parameter units by the incorporation of a Computer Numerical Control ("CNC") continuous path system, so that the motion ratio and/or positional condition of each axis of the hydraulic subpress, with respect to the movement of the mechanical press, can be varied within preset limits, preferably steplessly, while the draw frame of the mechanical press, acting as the principal guide axis, moves over a fixed 360° path-time curve.

In another of its aspects, the present invention provides for pressure-actuated control of the hydraulic cylinders of the various operating axes in the hydraulic subpress by means of independent control loops and high pressure pumps, whereby each control loop, other than the position sensor of the mechanical press, provides appropriate position feedback.

These means help to provide each operating axis of the hydraulic subpress with its own drive arrangement independent of all other operating axes thereof, and to make each operating axis directly dependent on the mechanical press. This provides interference-free control with optimal efficiency for each of the operating axes in the hydraulic subpress.

In practical operation of the press system according to the present invention, it has been shown advantageous to provide for the selective adjustment of the control pressure and backpressure for the hydraulic cylinder of the M operating axes of the hydraulic subpress, whereby the control pressure and backpressure can be adjusted to maxima of 70 and 350 bars respectively. Pressure in the hydraulic cylinder for the Z and Y axes can be adjusted servohydraulically to a maximum pressure of 350 bars. Provision should preferably be made for selective servohydraulic adjustment of the pressure in the hydraulic cylinder of the M axis to a maximum of 350 bars as well.

It has further proven advantageous in practice if a maximum of 50% of the mechanical press design pressure rating can be applied to each individual operating axis in the hydraulic subpress. This arrangement provides optimal material and pressure distribution at the various molding levels, thus ensuring the production of perfect moldings.

The modular construction of a press according to the present invention can also be enhanced by provision for the secure but detachable connection of the hydraulic subpress to the draft frame and platen of the mechanical press using clamping wedges, so that the subpress can be easily removed, if necessary, and so that an existing mechanical press can be easily adapted to various requirements by the simple installation of the hydraulic subpress. In this context, it has furthermore proven important in practice for a hydraulic subpress subpress with at least three operating axes to form an integral modular package mountable in the mechanical press.

The hydraulic subpress combines a compact space envelope with a high level of dimensional stability, with the result that the travel of the hydraulic cylinders for the various operating axes in the hydraulic subpress may be a mere fraction of the stroke of the operating axis in the mechanical press. In most cases, the travel of the hydraulic cylinders in the hydraulic subpress amounts to only 20 mm, whereas the stroke of the operating axes in the mechanical press may be as much as 120 mm.

Although the operating axes of the hydraulic subpress travel in the same direction as the operating axis of the mechanical press, the former can also be arranged to travel in the opposite direction, if required for process purposes.

It has proven useful in many cases for the mechanical press to be provided with a counterram or retraction ram (the E axis), which is also actuated by a mechanical drive system, preferably by a cam drive.

In the context of the present invention, the electric and/or electronic position sensor for the control and adjustment of the hydraulic subpress may be arranged and/or installed between the draft frame and the platen, while the other electric and/or electronic position sensors for selective position scanning are placed at the various operating axes of the hydraulic subpress. Through a CNC continuous path control system and the position parameter inputs, the travel of each axis in the course of molding operation can be derived from the position sensors, compared and proportionally readjusted, if necessary, as a direct function of the position of the mechanical press along the main guide axis.

In many applications for a press according to the present invention, it may further be important to provide an arrangement whereby the individual axes of the hydraulic subpress can be locked up or released with respect to one another, thus providing a simple means of adjusting the hydraulic subpress to the shape of the molding.

For optimal operation of the hydraulic subpress, positional scanning sensors are preferably arranged directly opposite the piston and the cylinder housing of the corresponding hydraulic cylinder, and communicate with the position sensor of the mechanical press over the CNC continuous path control system and/or the associated microprocessor.

A desirable feature of the invention particularly useful for the production of relief-cut moldings, lies in the fact that after the molding position, i.e., the bottom dead center point of the X axis is reached, the press can be moved in the opposite direction for molding or other purposes, simply by switching or actuating the Y axis.

A means according to the present invention for operating a press for the production of precision moldings from pulverized materials is essentially characterized in that mechanical press movement is compounded with at least one hydraulic press movement, whereby the hydraulic movement is controlled and/or adjusted as a direct and exclusive function of the mechanical press movement. The fact that the operating precision and speed of a combination press operated in this way are essentially dependent on the mechanical press, ensures exact repeatability.

It is further envisioned that, for the speed of hydraulic press operation to be determined and/or influenced as a function of the speed and travel of the movement of the mechanical subpress, thus allowing optimal compression of the powdered material inside the mold.

A press according to the present invention and the means of operating such a press can be employed in an especially advantageous way in the production of moldings from pulverized materials according to the so-called double die method, as described in the "Handbook of Modeling Technology", pp. 854–856, published in 1981 by the Karl Hanser Verlag, Munich.

BRIEF DESCRIPTION OF THE DRAWING

The subject of the present invention is shown in the drawings, where.

DESCRIPTION OF THE PREFERRED EMBODIMENT

Figure 1:
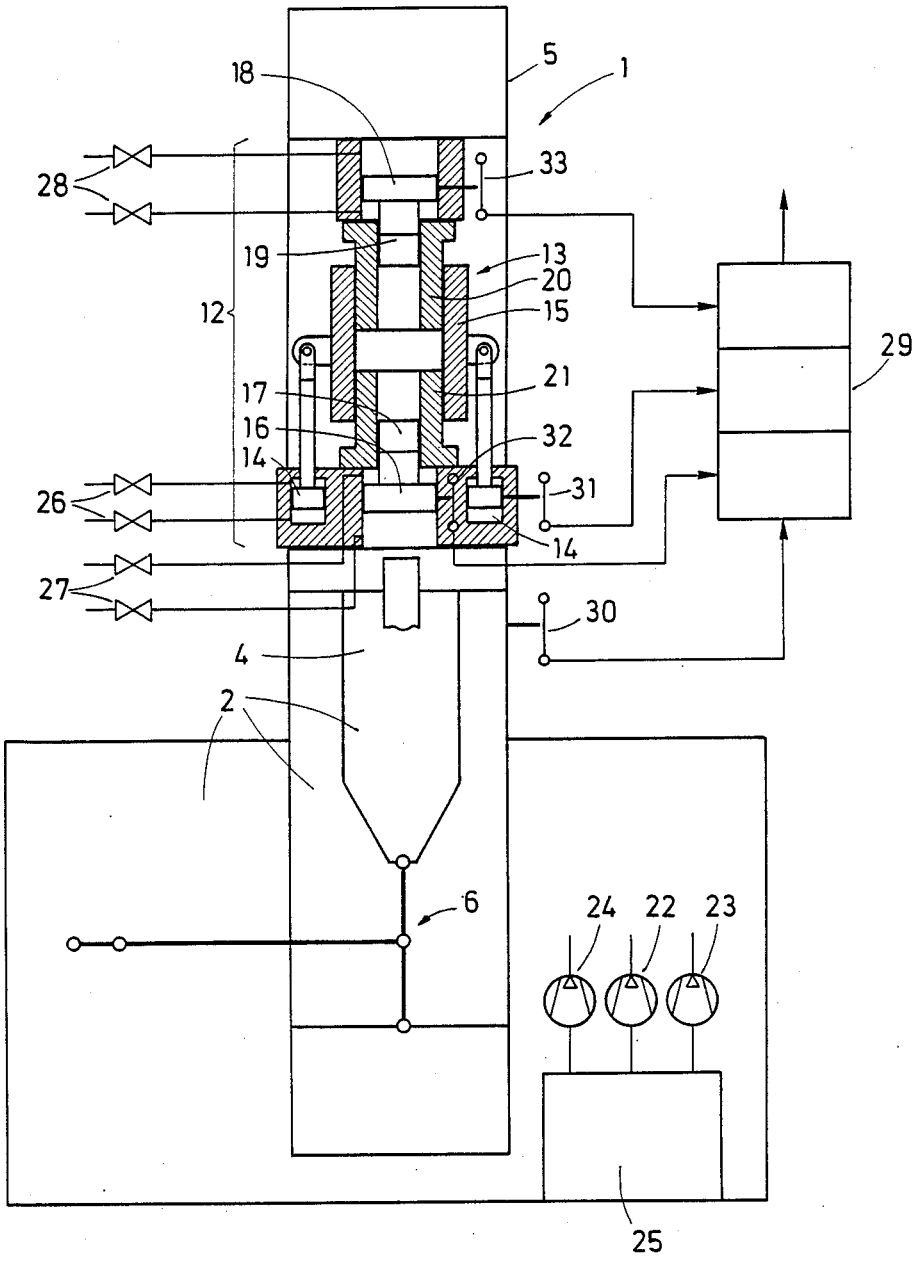
FIG. 1 is a diagrammatic illustration of the overall design principles of the hydromechanical press system of the invention.

FIG. 1 shows a hydromechanical press system 1, whose mechanical aspects are provided by a toggle-driven press 2. This toggle press comprises a base frame 3 supporting a platen 4 and having spaced uprights providing ways in which an open, rectangular draft frame 5 is mounted so as to be movable up and down with respect to the platen 4.

Figure 2:
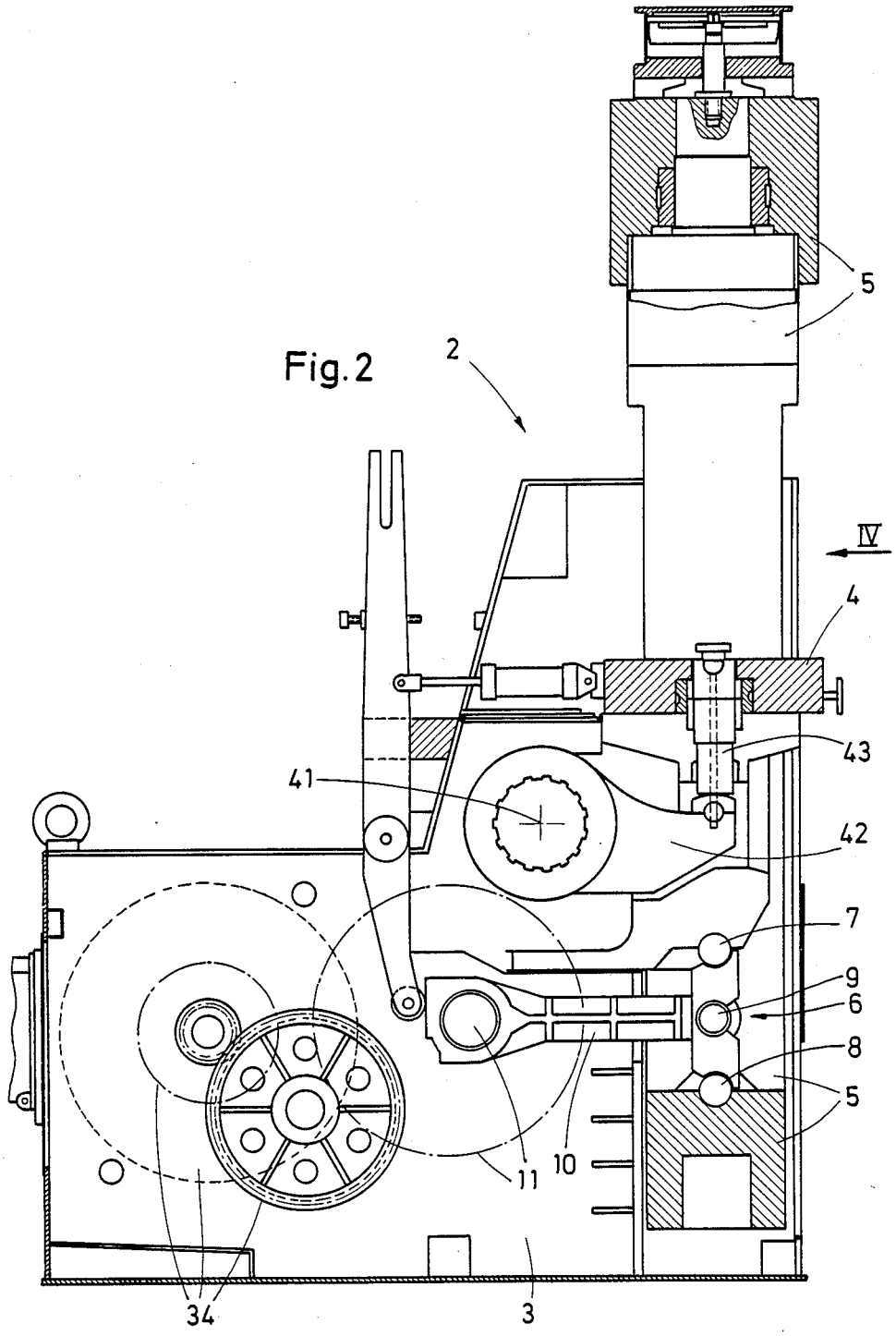
FIG. 2 is a partly sectioned side elevational view of the mechanical part of the press system of FIG. 1, illustrating the toggle drive and other mechanical operating features.
Figure 4:
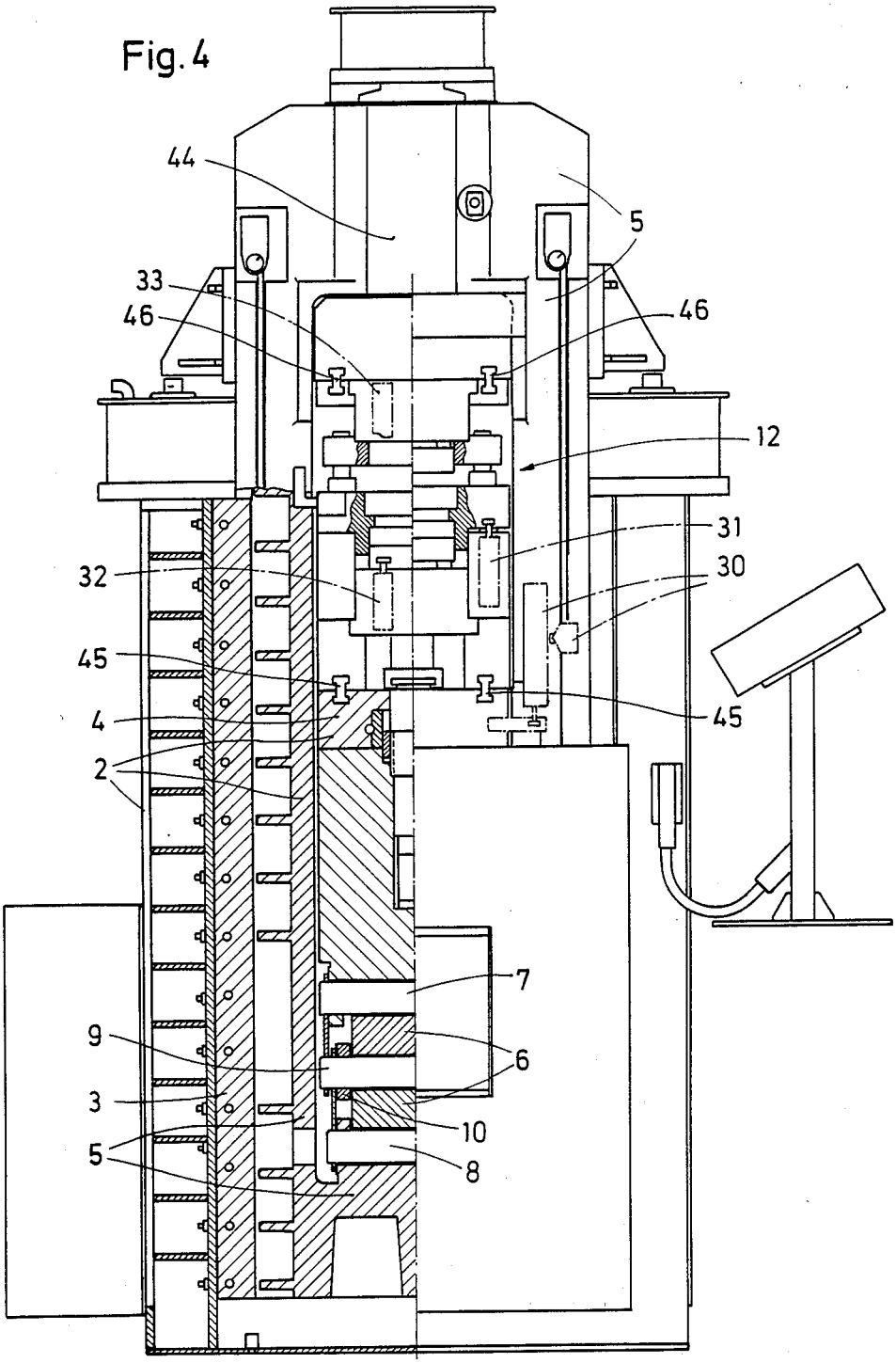
FIG. 4 is a partly sectioned frontal elevation, i.e., taken in the direction of the arrow IV of FIGS. 2 and 3, showing the hydromechanical press formed by the installation of a hydraulic subpress in the mechanical press.

Referring to FIGS. 2 and 4, the draft frame 5 is moved in the base frame 3 by a toggle-linkage 6 hinged at 7 to the base frame 3 on the one hand, and hinged at 8 on the lower crossmember of the draft frame 5, on the other hand.

A pushrod 10 is pivoted to the knee 9 of the toggle linkage 6 and journalled on the crank pin 11 of a crank drive housed in the base frame 3, but omitted from FIG. 1 for greater clarity.

The pushrod 10 is actuated by the drive over a fixed 360° time and motion curve so that the toggle linkage 6 performs a continuous alternating movement between its extended position and a preset bent position, whereby the draft frame 5 performs a precisely programmed relatively long stroke movement with respect to the stationary platen 4.

In a mechanical press which takes the form of the toggle press 2, a hydraulic subpress 12, being mounted in the opening between the fixed platen 4 and the upper crossmember 44 of the draft frame, can be moved upwards and downwards with the draft frame 5, the press tool 13 proper being incorporated in the hydraulic subpress 12.

The main ramming action of the hydromechanical press system 1 results from the combined operation of the platen 4 and the draft frame 5 of the mechanical press, namely the toggle press 2, and acts as the so-called X axis, the principal guide axis for the entire hydromechanical press system.

Furthermore, the hydraulic subpress 12 of the hydromechanical press system 1 provides at least one and preferably several further operating axes within the overall system 1. As shown by FIG. 1, the hydraulic subpress 12 can be arranged, for example, to provide three additional operating axes, namely the so-called M, Z and Y axes. In this case, the M axis actuates the block 15 of the press tool 13 through double-acting cylinder 14, whereas the Z axis actuates a piston rod 17 in the press tool 13 through double-acting cylinder 16, and the Y axis movement is provided by an upper piston rod 19 of double-acting cylinder 18. The main upper ram 20 and the main lower ram 21 are actuated by the main ram of the toggle press 2 acting as the X axis of movement between the platen 4 and the draft frame 5, thus carrying out the main press movement within the hydromechanical press system 1.

Oil under pressure is supplied to the cylinders 14, 16 and 18 of the hydraulic subpress 12 by high pressure oil pumps 22, 23 and 24 operating independently but connected to a common fluid reservoir 25. The oil supply to and from the hydraulic cylinders 14, 16 and 18 is controlled and regulated by solenoid valves 26, 27 and 28, which are in turn operated by the electronic positional parameter input units 29. The electronic positional parameter input units 29 are readily programmed through a CNC continuous path control system operating from a reference scale on the X axis. That is, input to the electronic positional parameter input units 29 is compared with that from an electronic positional sensor 30 (FIGS. 1 and 4), installed along the main guide axis of the hydromechanical press system 1, namely, the toggle press 2, between the latter's platen 4 and draft frame 5.

Through the medium of the electronic positional parameter input unit 29, relative movement with respect to the main guide axis, the so-called X axis, can be preset for each individual axis of the hydraulic subpress 12, namely for the M, Z and Y axes. The valve systems 26 through 28 for the hydraulic cylinders 14, 16 and 18 of the M, Z and Y axes are governed by the positional sensor 30 of the X axis and the electronic positional parameter inputs 29, so as to provide proportional control and/or regulation of the oil supply to the cylinders 14, 16 and 18 from predetermined positional settings of the sensor 30.

Closed control loops are formed by the provision of additional independent position sensors 31, 32 and 33 for each hydraulic cylinder 14, 16 and 18, providing selective position scanning functions for the aforesaid cylinders with continuous feedback of positional data to the electronic positional parameter input units 29. Corresponding to the position sensor 30 between the platen 4 and the draft frame 5 of the toggle press 2, the individual valve systems 26, 27 and 28 are governed through the electronic position parameter input units 29 so as to ensure precise maintenance of the present positional parameters in the hydraulic subpress 12.

Optimal performance of output, feedback, control and correction functions of the hydraulic subpress are provided over the electronic position sensors 31, 32 and 33 and position parameter input units 29 formed by a microprocessor and the CNC continuous path control system, because each individual axis, namely the M, Z and Y axes, operates in conjunction with its own closed control loop whose regulating variables are programmed by the position sensor 30 at the main press ram of the mechanical press, namely the X axis of the toggle press.

The valve systems 26, 27 and 28 which serve to supply oil pressure to the hydraulic cylinders 14, 16 and 18 are designed or arranged so that they can be selectively adjusted through the several servo control loops for the M, Z and Y axes of the hydraulic subpress, provision being preferably made for adjusting the control pressure up to 350 bars. Furthermore, provision is made through a special valve unit for selective adjustment of the pressure in the M axis up to 70 bars on the discharge side and 350 on the backpressure side. Oil pressure can be supplied independently to the hydraulic cylinder 14 for the M axis, the hydraulic cylinder 16 for the Z axis and the hydraulic cylinder 18 for the Y axis at a maximum of 50% of the design load of the mechanical press, namely the toggle press 2; this feature permitting optimal working results to be obtained for the production of moldings from pulverized materials.

In the hydromechanical press system 1, the travel of the hydraulic cylinders 14, 16 and 18 assigned to the M, Z and Y axes of the hydraulic subpress 12 amounts to a mere fraction of the stroke of the mechanical press on the X axis. The stroke of the main X axis ram between top and bottom dead centers is at least 120 mm, whereas for the hydraulic cylinder 14, 16 and 18, travel of about 20 mm has proved adequate.

An important feature of the present invention lies in the fact that oil pressure can be supplied to the double-acting hydraulic cylinders 14, 16 and 18 assigned to the M, Z and Y axes of the hydraulic subpress 12 either in the same direction, or opposite to, the movement of the X axis, as required.

A further feature of the present invention is the provision of an arrangement whereby the individual axes of the hydraulic subpress, namely the M, Z and Y axes, can be activated or deactivated with respect to one another, thus providing a simple means of adapting the hydromechanical press system to different production requirements.

It is of fundamental importance for operation of the hydromechanical press system 1 that it be possible to compound mechanical operating movement of the press with at least one hydraulic operating movement and that, in this connection, the latter movement be controlled and/or regulated as a direct and exclusive function of the former movement. In this context, the speed of the hydraulic operating movement is determined and/or influenced by the speed of the mechanical operating movement in proportion to its travel, with the result that optimal compression of the pulverized materials used in the production of precision moldings can be achieved and the formation of stress-relieving cracks can be effectively avoided.

Figure 3:
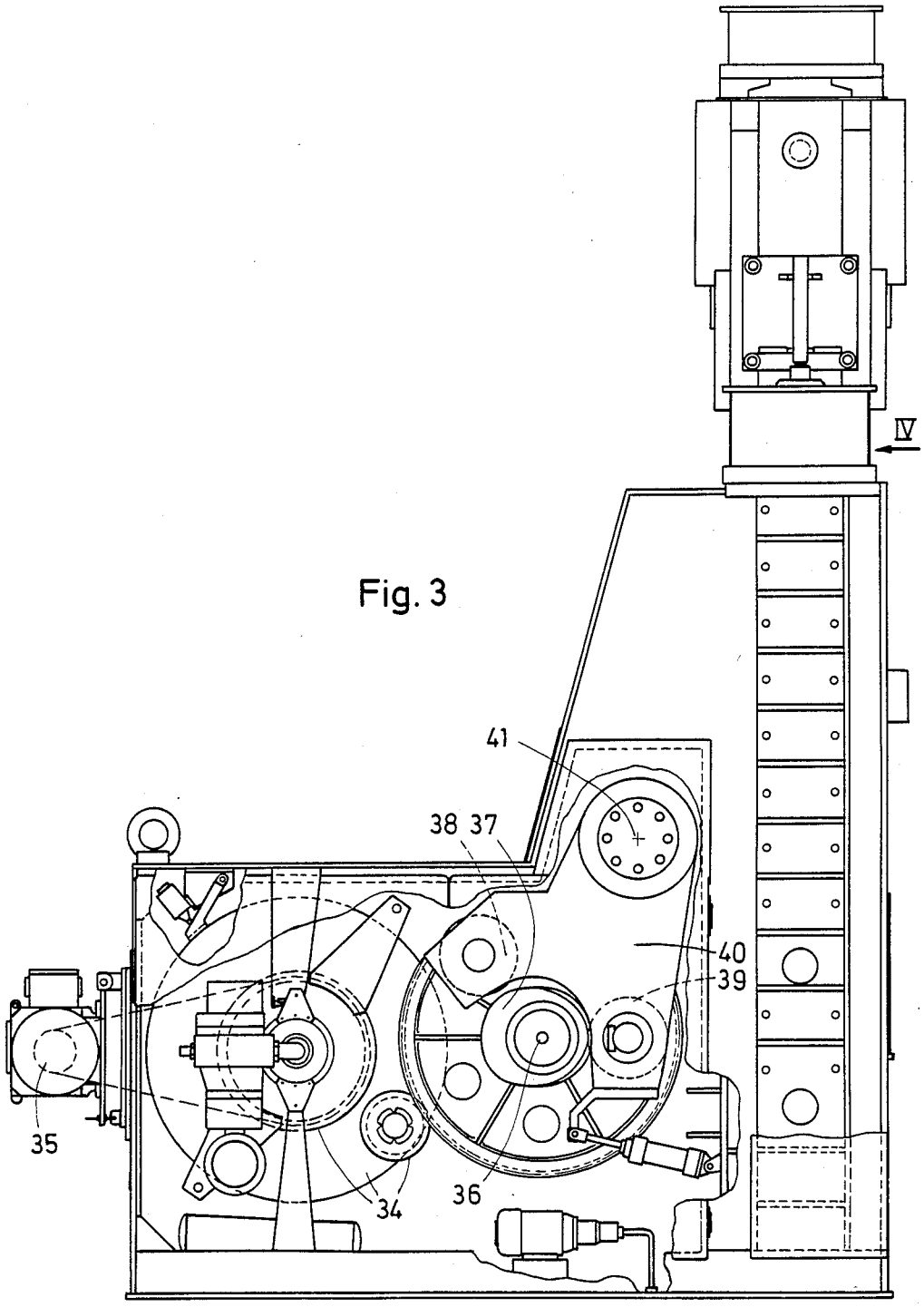
FIG. 3 is a similar side elevation of the mechanical press illustrating the drive for the second ram whose height can be adjusted in the platen and which can be used to apply a pulling or pressing effort (G axis)
Figure 5:
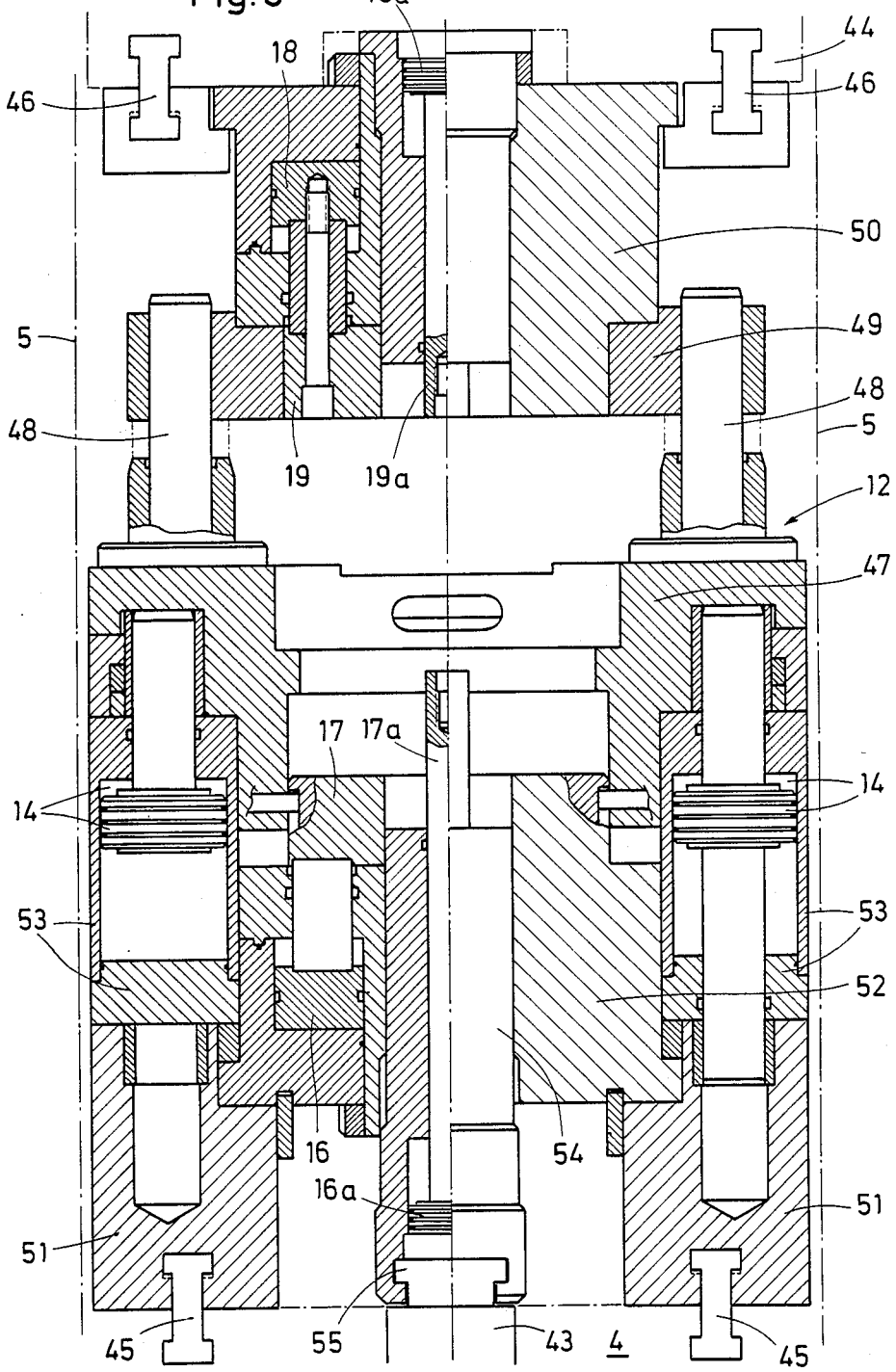
FIG. 5 shows an enlarged vertical section of only the hydraulic subpress portion of the hydromechanical press system shown in FIG. 4.

FIGS. 2 and 3 show details of the basic construction of the mechanical subpress, namely the toggle press 2, shown in a vertical section and side view, whereas FIG. 4 shows a front elevation and partial section of the general arrangement of the hydromechanical press system. FIG. 5 finally shows an enlarged detail of a vertical section of the hydraulic subpress 12 adapted to the toggle press shown in FIG. 4.

It can be seen from FIGS. 2 and 4 that the draft frame 5 is mounted on the base frame 3 so as to be able to rise and fall with respect to the platen 4, the draft frame 5 being driven by the toggle system 6, which is actuated via a crank mechanism 11 by the pushrod 10 in the form of a connecting rod. The crank mechanism 11 in this case is maintained in readiness for functional connection with a flywheel driven continuously by an intermediate gear or reducer 34, which is driven in turn by the electric motor 35, which is shown in FIG. 3, for example.

Referring to FIG. 3, a cam plate 37 is keyed to a bearing journal extension 36 of the crankshaft of the crank drive mechanism 11, to enable the aforesaid cam plate to be easily changed and to be replaced, if necessary. The various cam plates 37 can be given various curved shapes and can even be provided with dual cams, if required.

A rocker follower 40 operates in conjunction with the cam plate 37 by means of a contact roller 38 or a contact roller 39, and in a dual cam application, in conjunction with both rollers 38 and 39 at the same time, the rocker 40 being keyed to a shaft 41 which is supported in the base frame 3 so as to rotate over a narrow angle. In this connection, a lever 42 (FIG. 2) is mounted elsewhere on the shaft 41 to actuate a counterram and/or extraction ram 43 which is mounted to rise and fall in the platen 4. The counterram and/or extension ram 43 forms in this case a further axis, namely the so-called G axis, within the hydromechanical press system 1, the aforesaid G axis being actuated in a pattern determined by the selected cam plate 37 as a direct mechanical function of the toggle drive 6. FIG. 4 shows a partial section of the general arrangement of the hydromechanical press system 1 with the toggle press 2 and the hydraulic subpress 12. Here, the draft frame 5 is arranged in the base frame 3 so as to be able to move up and down on the flanking ways, and the platen 4 received within the central space of the reciprocable draft frame 5, is firmly secured to the base frame 3.

The hydraulic subpress 12, in the form of an integrally packaged mounting module, rests on the platen 4 to which it is firmly mechanically keyed by means of clamping wedges 45, so as to be easily removable, if necessary. In addition, the hydraulic subpress 12 is similarly mechanically coupled to the upper transverse yoke 44 of the draft frame 5, from which the aforesaid hydraulic subpress can also be easily removed if necessary. The hydraulic subpress 12 can be rapidly mounted and dismounted from the mechanical toggle press 2 from the front of the latter.

As can be seen especially clearly in FIG. 5, the hydraulic subpress 12 is provided with a die holder 47 in which the die 15 of the press tool 13 shown in FIG. 1 can be housed. Here, the die holder 47 is functionally connected to the upper die guide 49 by the guide posts 48, the former being arranged opposite a die guide 50. A further die support 52 bears on lateral supports 51 which are anchored to the platen 4 by means of clamping wedges 45.

Up to four hydraulic cylinders 14 can be operated in conjunction with the die holder 47, whereby the counterbearings of the cylinder bodies 53 are supported on the lateral supports 51.

A ram extension 54, which can move up and down in the adapter and/or die support 52, is coupled to the counterram or retraction ram 43 of the G axis of the toggle press 2.

An auxiliary hydraulic cylinder **16*a* is housed in the ram extension 54, whose piston rod 17*a* actuates the auxiliary axis of the hydraulic subpress 12** shown here. This arrangement is mainly employed for auxiliary core die travel.

A second auxiliary hydraulic cylinder **18*a* acting on the piston rod 19*a*, is provided in the die support bracket 50** and can be used as a second auxiliary axis for die block travel and block travel under load.

In order to ensure that the hydraulic subpress 12 provides a high level of precision and optimal efficiency, it is important for the position sensors 30, 31, 32 and 33 for the X, M, Y and Z axes, respectively, shown in FIGS. 1 and 4, to be directly connected to the platen 4 and the draft frame 5 and to its associated cylinder body and piston rod, respectively.

FIG. 5 clearly shows that the hydraulic subpress 12, together with all operating axes, namely the M, Z and Y axes and the associated cylinders 14, 16 and 18 form an integral mounting package incorporating the ram extension 54 for the counterram and retraction 43 as well. The positive locking coupling connection between the ram extension 54 and the counterram 43 is provided by a coupling part 55 above the platen 4 of the toggle press 2.

It can also be clearly seen in FIG. 5 that the hydraulic cylinders 14, 16 and 18 are designed to produce a relatively short stroke of about 20 mm, for example, which amounts to only a small fraction of the stroke of the toggle press 2, which should be at least 120 mm between top and bottom dead centers.

Figure 6:
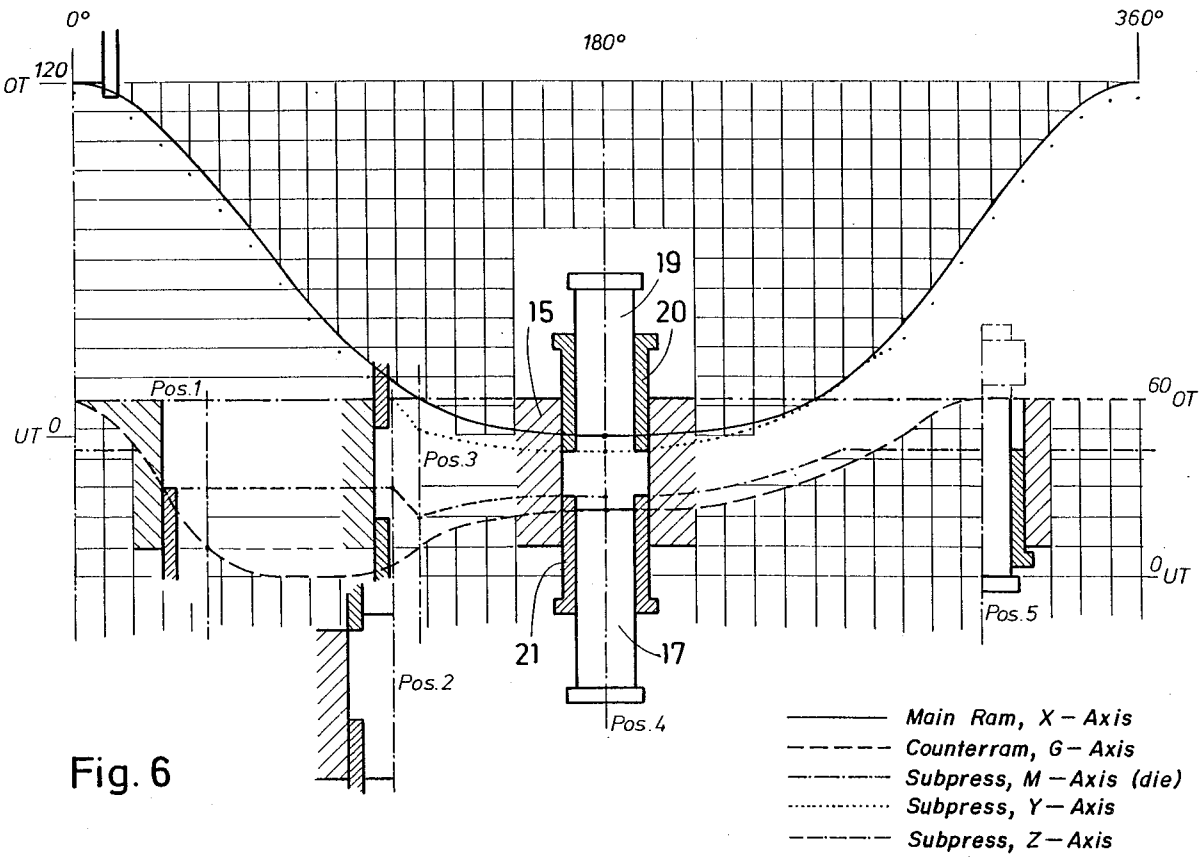
FIG. 6 is a diagram of the movement pattern of a hydromechanical press system for molding powder materials using the counterpress method with a vertical die.

FIG. 6 shows a working diagram of the hydraulic subpress 12 of the type described above in detail with the help of FIGS. 1 to 5.

On the abscissa of the coordinate system, the diagram of FIG. 6 shows an angular range of 0°–360° corresponding to one complete rotation of the crank mechanism 11 which actuates the toggle 6. The ordinate shows the stroke travel between the top bottom dead centers OT and UT respectively of the hydromechanical system 1 forming the X axis and of the travel of the main press ram formed by the platen 4 and the draft frame 5 during one complete rotation of the crank mechanism 11.

The sine curve shown as a solid line represents the movement curve of the main ram or X axis of the toggle press 2. The straight horizontal line of dots and dashes indicates that the M axis and/or the die 15 remain at rest during the particular pressing operation shown.

The dotted line parallel to the solid line of the sine curve shows the movement pattern of the Y axis during a press operation, whereas the line of dashes shows the movement pattern of the G axis, and the line of dots and double dashes represents the movement pattern of the Z axis.

Position 1 in the diagram shows the filling or supply cycle of the press tool 13, in which the press is filled with pulverized material. Position 2 shows the position of the press in which the material distribution cycle is carried out. Position 3 shows the distribution position of the tool, Position 4 shows the press in operation, and Position 5 shows the press in the discharge cycle.

As emphasized above, the X axis of the toggle press 2 forms the main and guide axis for the hydromechanical press system 1, i.e., the working movements of all the axes of the hydraulic subpress, the M, Z and Y axes are controlled by the X axis, whereby movement on all of these axes can be varied by varying the corresponding position parameter input units 29 to meet different requirements. Depending on the settings of the position parameter input units 29, the working movement of the hydraulic subpress 12 is controlled and regulated through the valve systems 26, 27 and 28.

On the other hand, the working movement of the G axis is derived from the drive system of the toggle press 2, whereby the cam plates 37 are configured as alternating cams with different contours for the retraction, discharge and counterpressure cycles.

The time and motion relation for the movement of the main ram of the toggle press 2 is a fixed parameter however and thus provides an advantageous basis for the main and/or guide axis of the hydromechanical system 1.

All the hydraulic, electric and electronic components of the hydraulic subpress 12 are pre-assembled so that it can be easily mounted in and removed from the toggle press 2 and equally easily integrated into the control system of the mechanical press with quick disconnect couplings.

For the production of relief-cut moldings, split die forms must be used, because the moldings cannot be released otherwise. For this purpose, the hydraulic subpress 12 must be operated with reverse movement and/or return repressing movement. In this case, the X axis will move backwards after reaching its operating position whereas the Y axis will be moved to a provisional position at the same time. In the course of this process, the working pressure in the Y axis is maintained by the operating axis as it moves backwards. After the pressing operation, the molded article can be removed upon the die separation.

What is claimed is:

1. In a press for the production of precision moldings from pulverized materials comprising a base frame having thereon a platen, a draft frame guided in ways on the base frame for movement relative to the platen, and a mechanical drive connected between the base frame and the draft frame for cyclically moving the draft frame in its ways to constitute the principal ram and to provide the principal axis of press movement, the improvement comprising a hydraulic subpress interposed between the draft frame and the platen and providing at least one additional axis of press movement, means supplying fluid under pressure to said hydraulic subpress, and a control mechanical including remotely operated hydraulic valves to govern the flow of pressure fluid to and from said hydraulic subpress, and means for operating said valves to power the subpress in response to the position of the draft frame during its cyclical movement relative to the platen.

2. The subject matter of claim 1 wherein the means for operating the valves is adjustable to respond selectively to various positions of the draft frame in its cyclical movement with respect to the platen.

3. The subject matter of claim 2 wherein the hydraulic subpress incorporates multiple additional axes of movement each provided by at least one hydraulic cylinder separately adjustably responsive to the position of the draft frame relative to the platen.

4. The subject matter of claim 3 wherein each of the cylinders of the multiple additional axes of the hydraulic subpress is further provided with its own drive pump, valves, and control loop, and wherein the valves are electrically operated, each said control loop includes an electrical feedback sensor responsive to the position of its associated cylinder, a further electrical sensor senses the position of the draft frame relative to the platen, and a computer numerical controller connected to said valves and said respective position sensors provides the adjustability of the operation of the valves.

5. The subject matter of claim 4 wherein the hydraulic pressure available from each pump is adjustable up to 350 bars.

6. The subject matter of claim 4 wherein the hydraulic pressure available from each pump is one-half of the rated pressure exertable by the principal ram.

7. The subject matter of claim 1 wherein the hydraulic subpress is mechanically coupled respectively to the draft frame and platen of the principal ram by clamping wedges which are removable to demount the subpress.

8. The subject matter of claim 3 wherein the multiple axis subpress is constructed as a separately packaged module mountable in the press by detachable connections to said draft frame and platen respectively.

9. The subject matter of claim 3 wherein the stroke of each of the cylinders of the subpress is but a minor fraction of the stroke of the principal ram.

10. The subject matter of claim 3 wherein the hydraulic cylinders of each of the multiple axes of the subpress are double-acting and drivable in the same or opposite direction as the principal ram.

11. The subject matter of claim 1 wherein the press is provided with a counterram coaxial with the principal ram, and wherein the counterram is actuated by a mechanical cam drive.

12. The subject matter of claim 4 wherein any of the several additional axes of the subpress is disableable individually.

13. The subject matter of claim 4 wherein the position scanning feedback sensors of the hydraulic subpress are mounted in direct association with the pistons and cylinders of their respective axes.

* * * * *

UNITED STATES PATENT AND TRADEMARK OFFICE

CERTIFICATE OF CORRECTION

PATENT NO. : 4,917,588

DATED : April 17, 1990

INVENTOR(S) : Thomas Gräbener et al.

It is certified that error appears in the above-identified patent and that said Letters Patent is hereby corrected as shown below:

Column 10, line 9, change "mechanical" to --mechanism--.

Signed and Sealed this

Twenty-third Day of July, 1991

*Attest:*

HARRY F. MANBECK, JR.

*Attesting Officer*

*Commissioner of Patents and Trademarks*